US005943025A

United States Patent [19]

Benham et al.

[11] Patent Number: 5,943,025

[45] Date of Patent: Aug. 24, 1999

[54] TELEVISION ANTENNAS

[75] Inventors: Glynda O. Benham; John R. Benham, both of Sterling; Marshall W. Cross, Stow, all of Mass.

[73] Assignee: Megawave Corporation, Boylston, Mass.

[21] Appl. No.: 08/922,500

[22] Filed: Sep. 3, 1997

Related U.S. Application Data

[63] Continuation of application No. 08/383,906, Feb. 6, 1995, abandoned.

[51] Int. Cl.[6] ..... H01Q 9/28

[52] U.S. Cl. ..... 343/795; 343/802; 343/807

[58] Field of Search ..... 343/700, 744, 343/795, 802, 805, 806, 807, 808, 809, 810, 811, 803, 846

[56] References Cited

U.S. PATENT DOCUMENTS

| | | | |
|---|---|---|---|
| 2,978,703 | 4/1961 | Kuecken | 393/795 |
| 3,369,245 | 2/1968 | Rea | 343/795 |
| 3,673,044 | 6/1972 | Miller et al. | 156/433 |
| 3,721,990 | 3/1973 | Gibson et al. | 343/795 |
| 3,836,976 | 9/1974 | Monser et al. | 343/795 |
| 3,958,245 | 5/1976 | Cherenko et al. | 343/713 |
| 3,987,449 | 10/1976 | DeAngelis et al. | 343/713 |
| 4,038,662 | 7/1977 | Turner | 343/752 |
| 4,072,954 | 2/1978 | Comastri et al. | 343/713 |
| 4,114,163 | 9/1978 | Borowick | 343/795 |
| 4,141,011 | 2/1979 | Boaz | 343/713 |
| 4,145,694 | 3/1979 | Sletten | 343/727 |
| 4,163,236 | 7/1979 | Kaloi | 343/700 |
| 4,302,760 | 11/1981 | Laufer | 343/715 |
| 4,358,769 | 11/1982 | Tada et al. | 343/742 |
| 4,485,385 | 11/1984 | Ralston | 343/795 |
| 4,513,290 | 4/1985 | Lefevre et al. | 343/745 |
| 4,707,700 | 11/1987 | Nagy | 343/712 |
| 4,736,206 | 4/1988 | Sakurai et al. | 343/703 |
| 4,746,925 | 5/1988 | Toriyama | 343/713 |

(List continued on next page.)

FOREIGN PATENT DOCUMENTS

| | | | |
|---|---|---|---|
| 162009 | 8/1953 | Australia . | |
| 77 148/81 | 5/1983 | Australia . | |
| 4307232 | 7/1993 | Germany | H01Q 1/32 |
| 0062902 | 4/1983 | Japan | 343/795 |
| 63-13402 | 7/1986 | Japan | H01Q 1/22 |
| 0171202 | 8/1986 | Japan | H01Q 1/32 |
| 0043905 | 2/1987 | Japan | H01Q 1/32 |
| 0081101 | 4/1987 | Japan | H01Q 1/32 |
| 3-196703 | 12/1989 | Japan | H01Q 1/32 |
| 4-213903 | 12/1990 | Japan | H01Q 1/32 |
| 5-14028 | 6/1991 | Japan | H01Q 1/32 |
| 6291530 | 10/1994 | Japan | H01Q 1/32 |

OTHER PUBLICATIONS

Kanda, "The Time–Domain Characteristics of a Traveling–Wave Linear Antenna with Linear and Nonlinear Parallel Loads", IEEE Transactions on Antennas and Propagation, vol. AP–28, No. 2, Mar., 1980, pp. 267–276.

Rao, "Optimized Tapered Resistivity Profiles for Wideband HF Monopole Antenna", presented at the 1991 IEEE Antenna and Prop. Society International Symposium, London, Ontario, Canada, Mitre Corporation.

Clapp, "A Resistively Loaded, Printed Circuit, Electrically Short Dipole Element for Wideband Array Applications", IEEE, May 1993, pp. 478–481.

McMillan, "Log Spiral Design for Direction of Arrival Estimation," IEEE APS Symposium Proceedings, 1991.

(List continued on next page.)

*Primary Examiner*—Don Wong
*Assistant Examiner*—Tho Phan
*Attorney, Agent, or Firm*—Fish & Richardson P.C.

[57] ABSTRACT

A television antenna exhibiting a bandwidth including VHF and UHF, a low standing wave ratio, and an essentially omnidirectional radiation pattern. The antenna includes a sheet-like antenna element having a feedpoint, and an electromagnetic characteristic having non-uniform variation with distance from the feedpoint.

26 Claims, 5 Drawing Sheets

U.S. PATENT DOCUMENTS

| | | | |
|---|---|---|---|
| 4,768,037 | 8/1988 | Inaba et al. | 343/713 |
| 4,791,426 | 12/1988 | Lindenmeier et al. | 343/713 |
| 4,825,220 | 4/1989 | Edward et al. | 343/795 |
| 4,827,274 | 5/1989 | Armbruster | 343/712 |
| 4,849,766 | 7/1989 | Inaba et al. | 343/713 |
| 4,860,019 | 8/1989 | Jiang et al. | 343/795 |
| 4,910,380 | 3/1990 | Reiss et al. | 219/203 |
| 4,931,764 | 6/1990 | Gaston | 338/185 |
| 5,012,255 | 4/1991 | Becker | 343/704 |
| 5,119,106 | 6/1992 | Murakami | 343/713 |
| 5,126,716 | 6/1992 | Munger | 338/306 |
| 5,173,713 | 12/1992 | Yves et al. | 343/749 |
| 5,255,858 | 10/1993 | Day | 343/713 |
| 5,264,858 | 11/1993 | Shiina | 343/713 |
| 5,285,048 | 2/1994 | Nakase | 219/203 |
| 5,353,039 | 10/1994 | Tsukada et al. | 343/713 |
| 5,355,144 | 10/1994 | Walton et al. | 343/713 |
| 5,363,114 | 11/1994 | Shoemaker | 343/713 |
| 5,365,242 | 11/1994 | Shiina | 343/713 |
| 5,406,295 | 4/1995 | Baranski et al. | 343/713 |

OTHER PUBLICATIONS

Rao et al., "Wideband HF Monopole Antennas with Tapered Resistivity Loading", Mitre Corporation, presented at MILCOM'90, 1990 IEEE Military Comm. Conference, Monterey, CA Sep.30–Oct. 3, 1990, pp. 1223–1227.

Kanda, A Relatively Short Cylindrical Broadband Antenna with Tapered Resistive Loading for Picosecond Pulse Measurements, vol. AP 26, No. 3, May 1978, pp. 439–447.

Maloney et al., "Optimization of a Resistively Loaded Conical Antenna for Pulse Radiation", IEEE APS Symposium Proceedings, Jul. 1992, pp. 1968–1972.

Clouston, "The Butterfly: A Broadband, Aerodynamic Antenna for Airborne Missile Scoring Using Impulse Radar", IEEE APS Symposium Proceedings, 1991, pp. 715–718.

Wu et al., "The Cylindrical Antenna with Nonreflecting Resistive Loading", IEEE Transactions on Antennas and Propagation, vol. AP–13, No. 3, pp. 369–373, May 1965.

Kanda, "Time Domain Sensors for Radiated Impulsive Measurements", IEEE Transactions on Antennas and Propagation, vol. AP–31, No. 3, May 1983, pp. 438–444.

Shen, "An Experimental Study of the Antenna with Nonreflecting Resistive Loading", IEEE Transactions on Antennas and Propagation, vol. AP15, No. 5, Sep. 1967, pp. 606–611.

Maloney, "Optimization of a Conical Antenna for Puulse Radiation: An Efficient Design Using Resistive Loading", IEEE Transactions on Antennas and Propagation, vol. 41, No. 7, Jul. 1993, pp. 940–947.

Torres et al., "Analysis and Design of a Resistively Coated Windshield Slot Antenna", Technical Report 312559–1, The Ohio State University, PPG Industries, Inc., Jun. 1991.

Torres et al., "Integral Equation Analysis of a Sheet Impedance Coated Window Slot Antenna", IEEE Transactions on Antennas and Propagation, vol. 42, No. 4, Apr. 1994, pp. 541–544.

Lindenmeier et al., Multiple FM Window Antenna System for Scanning Diversity with an Integrated Processor, IEEE Transactions on Antennas and Propagation, 1990, pp. 1–6.

Austin et al., "Conformal On–glass Vehicle Antennas at VHF", IEE International Conference on Antennas and Propagation, England, 1993.

Austin, "Numerical Modelling and Design of Loaded Broadband Wire Antennas", University of Liverpool, Proc. IEE 1988 High Frequency Symposium, pp. 125–129, London, 1988.

Rao et al., "Resistivity Tapered Wideband High Frequency Antennas for Tactical Communications", 1992 Tactical Communications Conference, pp. 261–270, Ft. Wayne, Indiana, Apr. 1992.

1 section of segmented target linear magnetron

Key:

A Injection inlet
B Internal manifold
C Profiled extrusion aperture

TELEVISION ANTENNAS

This is a continuation of application Ser. No. 08/383,906, filed Feb. 6, 1995, now abandoned.

BACKGROUND OF THE INVENTION

This invention relates to television antennas.

Television receivers, for example, typically include "rabbit ears" and sometimes whips used for VHF and bowties or loops used for UHF. Rabbit ears and whips are usually adjustable to account for the different frequencies of different channels and the directionality of the incoming signals.

SUMMARY OF THE INVENTION

In general, an aspect of the invention features a television antenna exhibiting a bandwidth including all VHF and UHF channels, a low standing wave ratio, and an essentially omnidirectional radiation pattern. The antenna includes a sheet-like antenna element having a feedpoint, and an electromagnetic characteristic having non-uniform variation with distance element from the feedpoint.

Implementations of the television antenna may include the following features. The element may be generally rectangular. There may be multiple sheet-like antenna elements connected to the feedpoint. The element may be formed as a loop. The element may also be generally planar. There may be two antenna elements lying in a common plane. A conductive end-loading strip may be provided along one end of the antenna element. A balun or a unun may be connected between the feedpoint and a television receiver. A balun is a balanced-unbalanced to ground feed device. A unun is an unbalanced to unbalanced to ground feed device. A counterpoise element may be provided inclined at an angle to the plane of the antenna element. The electromagnetic characteristic may be an electrical characteristic, e.g., resistance. The non-uniform variation may be a monotonically increasing value with distance from the feedpoint. The value may increase in a step function. Each iso-resistive contour may be in the shape of a parabola centered at the antenna feedpoint, or a quadrant of an elipse, or a quadrant of a rectangle, or an oblique line. Each element of the antenna may be formed of a pair of subelements orthogonal to one another. The antenna may have two sheet-like elements simultaneously fed in a dipole mode and in a monopole mode. The feedpoint may be at a corner of each of the sheets. The feedpoints of the two elements may be connected to a summing device and to a differencing device. The sheet-like element may have a thickness profile that varies across the element.

In general, in another aspect, the invention features a method of sputtering metal onto a continuous substrate. The continuous substrate is fed past sputtering targets which are positioned to sputter metal onto the substrate in different regions across the width of the substrate. The sputtering targets are controlled to create a selectable thickness profile of sputtered metal across the width of the substrate. In implementations, the rate of feeding of the continuous substrate past the sputtering targets is also controlled to create a selectable thickness profile of sputtered metal along the length of the substrate.

In general, in another aspect, the invention features a method of making an antenna element by extruding a conductive polymeric material as a continuous sheet, and controlling the resistance profile of the extruded continuous sheet, by controlling its thickness profile during extrusion. Alternatively, the material may be molded or machined. The extrusion, molding, or machining is controlled based on the conductivity of the material and therefore the required element dimensions.

In general, in another aspect, the invention features a method of making an antenna element by applying conductive ink to a substrate, and controlling the resistance profile of the substrate by controlling a pattern in which the ink is applied.

Advantages of the invention include the following.

The antenna does not need to be continually adjusted depending on the channel or the directionality of the incoming signal. The radiation pattern and impedance characteristics of the antenna are nearly independent of frequency and therefore minimize the amount of adjustment needed to achieve the best picture quality. The tapered impedance loading renders the antenna relatively insensitive to movement of people or objects near the antenna and to the properties of the mounting surface (providing it is essentially dielectric in nature). An azimuthal radiation pattern without deep nulls can be achieved. Planar versions can be mounted flush with the upper surface of the TV receiver and are therefore unobtrusive. A lamp or other non-conducting object can be placed on top of the antenna without substantially degrading performance. In the case of a TV receiver, one antenna is used to replace the combined "rabbit-ears", whip and loop or bowtie combinations. The antenna is low-cost, lightweight, and capable of operating over the 54–216 MHz and 470–806 MHz frequency ranges. The antenna is low profile and visually unobtrusive, can be mounted on top a TV receiver cabinet, located on a nearby wall disguised as a picture frame, for example, or incorporated into the TV cabinet or TV screen. The antenna is relatively insensitive to its surroundings (e.g., movement of humans or objects placed on or near the TV set). The antenna does not need adjusting each time channel is changed. The antenna is a passive device (no external power supply is needed). The antenna is relatively inexpensive to fabricate and easy to make.

Other advantages and features of the invention will become apparent from the following description and from the claims.

Flat Sheet Dipole Antenna

Figure 1:
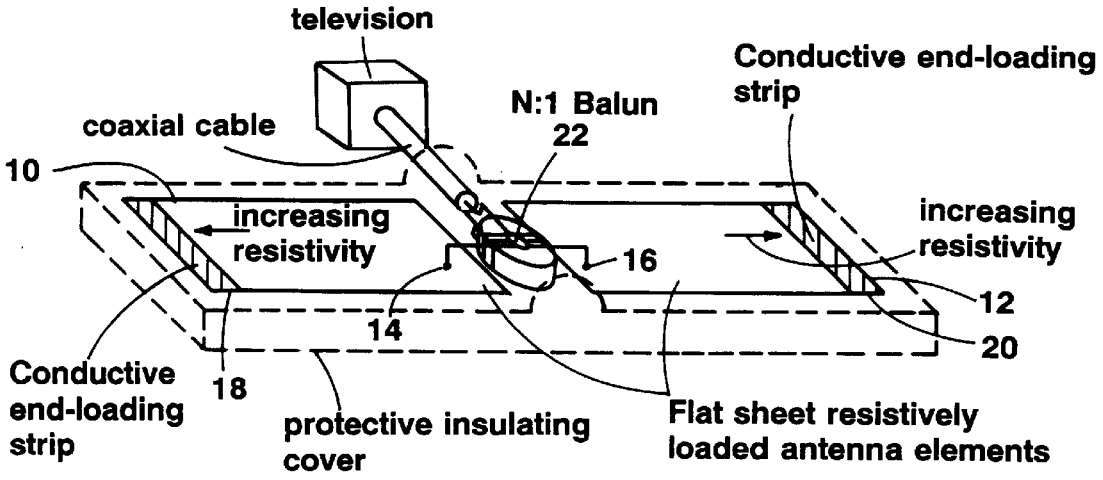
FIG. 1 shows a broadband loaded dipole using flat sheets.

In one example of a television antenna, shown in FIG. 1, the antenna elements 10, 12, are constructed from two identical flat sheets with resistive loading such that the resistance increases with increasing distance from the feed point 14, 16. The length (left to right in the figure) of each of the resistively loaded sheets is typically 20 to 30 cm. The length is selected for compactness of the final design. Because this length is much shorter than one quarter wavelength at the lowest VHF television frequency the feedpoint impedance of the antenna is adjusted by conductive strips 18, 20 placed at the ends of the antenna elements. This adjusts the antenna impedance at the lowest VHF frequency, making it less capacitive in nature, but has increasingly less effect on the antenna impedance as the frequency is increased. This allows a short resistively loaded antenna element to be reasonably matched to the television receiver input impedance across a wide frequency range, as is required in order to achieve efficient broadband performance. The width (vertical dimension in the figure) of the sheets used for the antenna elements is selected to achieve an antenna feedpoint impedance which is convenient to match with the input of the television receiver, wider sheets producing lower impedances, and is typically 7 cm to 12 cm.

A balanced to unbalanced transformer (balun) 22 with suitable impedance transformation has its balanced side connected to the resistively loaded sheets and is used to match the impedance of the elements into the input impedance of the television receiver.

By appropriate selection of the resistive loading profile of the antenna elements, the element widths, the dimensions of the conductive end-loading strip and the impedance transformation ratio of the balun, an efficient broadband antenna can be designed with a bandwidth covering the entire VHF and UHF television bands.

Vertical Sheet Monopole

Figure 2A:
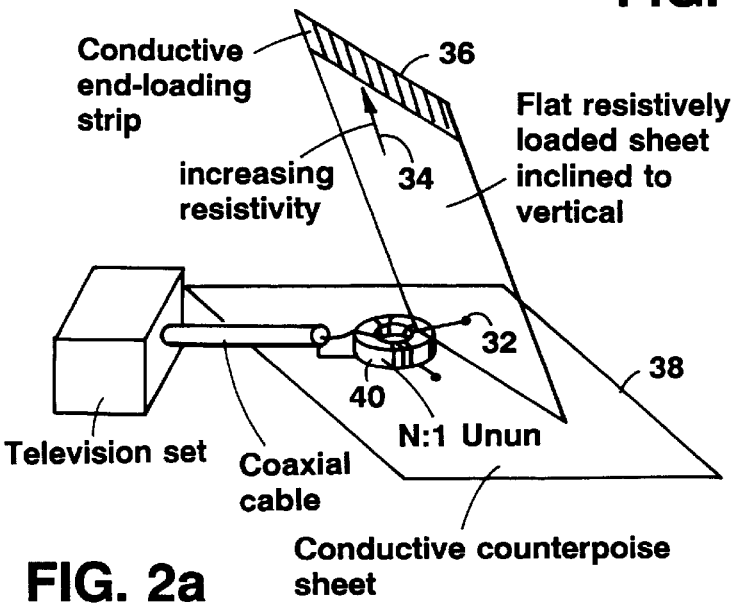
FIG. 2 shows a flat-sheet monopole.
Figure 2B:
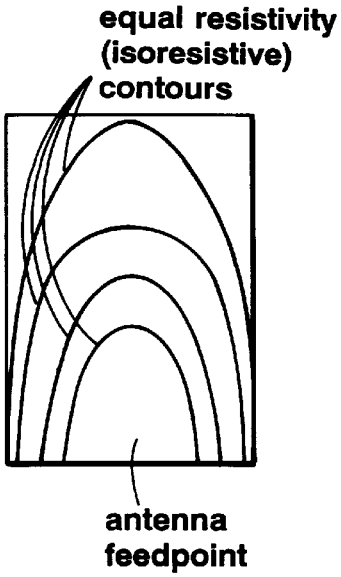

In the example of FIG. 2A, a monopole has a single broadband flat resistively loaded sheet element 30 suitable for reception of FM radio signals. In a simple implementation, the resistivity of the sheet used for the element increases only with distance from the antenna feedpoint 32 as indicated by arrow 34. In a more complex implementation, the resistivity of the element is varied both along the length of the element and laterally across the width of the element as indicated in FIG. 2B. By careful selection of the lateral variation in resistivity in the element of FIG. 2B, the development of lateral current components on the element at high frequencies may be suppressed, resulting in superior high frequency radiation characteristics. Typical dimensions for the antenna element sheet are 20 cm to 50 cm for the length along the element and 7 cm to 12 cm for the width. To provide impedance matching over a broad frequency range a conductive end loading strip 36 is connected at the upper end of the antenna element. A small (e.g., 20 cm×28 cm) conductive counterpoise 38 is placed below the sheet and inclined at an angle to the plane of the antenna element. The output voltage between the element and the counterpoise is fed to the input terminals of an balanced to unbalanced transformer, or balun 40, which is designed to match the terminal impedance of the antenna to the input impedance of the television receiver. The feedpoint is at or very close to the lower edge of the sheet 30, at a point which is mid way across its width.

By appropriate selection of the resistive loading profile of the antenna element, the element width, the dimensions of the conductive end-loading strip and counterpoise and the impedance transformation ratio of the balun, an efficient compact, broadband antenna can be designed with a bandwidth covering the VHF FM radio bands.

Hybrid Antenna with Vertical and Horizontal Responses

Figure 3:
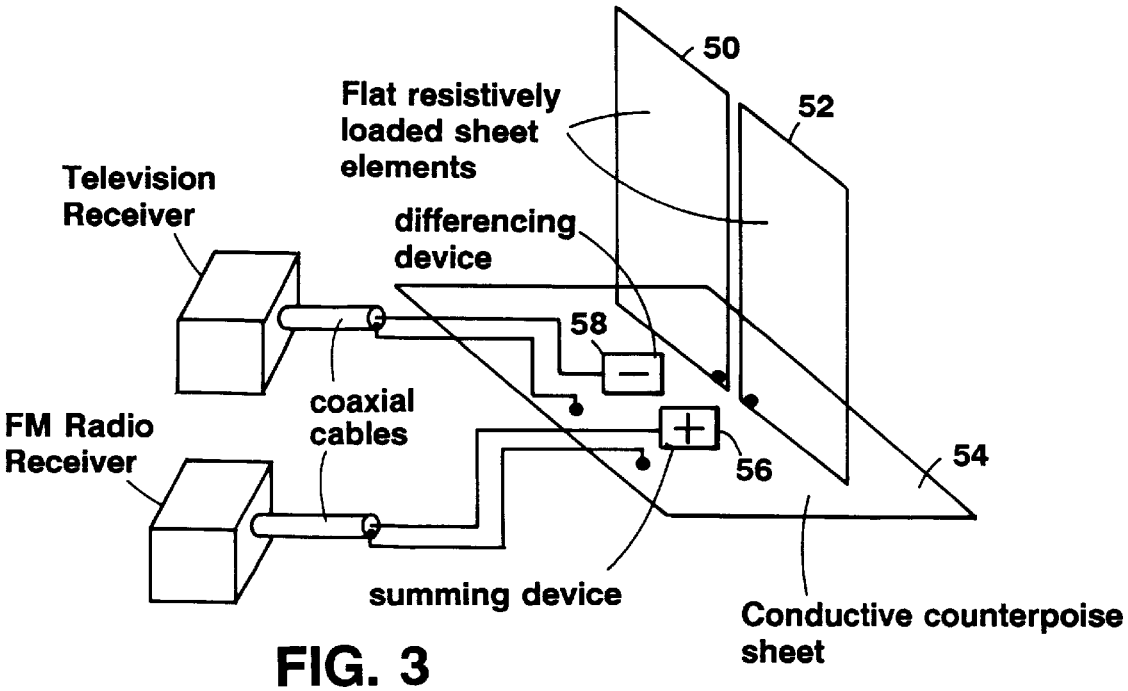
FIG. 3 shows a hybrid antenna for combined AM/FM radio and television reception.

FIG. 3 shows a hybrid design which combines the features of the antennas shown in FIGS. 1 and 2 to produce an antenna that can be used for reception of both FM radio and VHF/UHF television signals. Here two vertically mounted resistively loaded sheets 50, 52 are mounted orthogonally above a small conductive counterpoise 54. Typical dimensions for the two resistive antenna elements are 20 to 30 cm in length and 7 to 12 cm in width. The two resistively loaded sheets can be fabricated as patches of resistive material on a common insulating substrate material (not shown). A summing device 56, or electrical network whose output voltage is the sum of the input voltages at its two input terminals is connected to the adjacent bottom corners of the two resistively loaded plates. A differencing device 58, or electrical network whose output voltage is the difference of the input voltages at its two input terminals is also connected to the adjacent bottom corners of the resistively loaded plates.

The output of the summing device is proportional to the response of the two resistively loaded sheets jointly acting in the monopole antenna mode, and as such will respond to FM broadcast signals.

The output of the differencing device is the response of the two resistively loaded sheets acting in the dipole mode, and is the response of the antenna to horizontally polarized electromagnetic fields as commonly used for the transmission of television signals.

Because this antenna is required to be broadband in both the vertical and horizontal modes, a simple one dimensional variation of the element resistivity with the distance along the element length is no longer sufficient. FIG. 4 below shows several examples of the isoresistive contours that can be used for the sheets which compose the antenna elements in order to meet a number of requirements, where the resistivities r1 through rn are such that r1>r2>r3 . . . >rn.

Figures 4A, 4B, 4C, 4D:
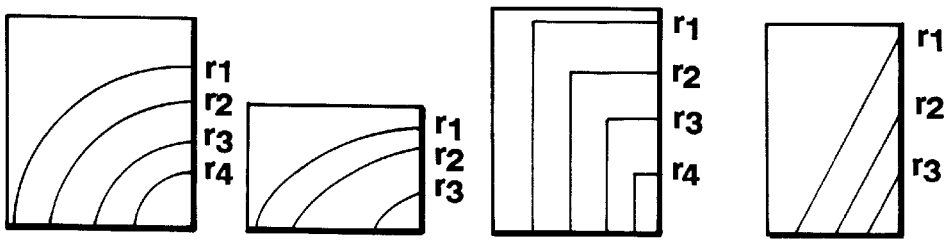
FIGS. 4A–D show resistivity contours for hybrid antenna elements.

FIG. 4A shows a configuration where the elements have essentially the same bandwidth in both horizontal and vertical reception modes, the isoresistive contours being essentially the arcs of concentric circles emanating from the corner of the sheet which forms the antenna feedpoint in the final antenna assembly. The arcs describe an angle of 90 degrees at the feedpoint.

FIG. 4B shows an element where the antenna dipole mode is desired to operate to lower frequencies than the monopole mode. The isoresistive contours in this case form the segments of a series of coaxial ellipses which emanate from the feedpoint corner of the sheet and which enclose an angle of 90 degrees. To achieve better low-frequency operation in the dipole mode the major axis of the ellipse lies in the horizontal plane. By suitable selection of the vertical and horizontal axes of the contours of the isoresistive ellipses the bandwidth of the vertical and horizontal modes can be adjusted.

FIG. 4C shows a simplification of the construction technique where the ellipses have been replaced with rectangles whose sides are scaled to be proportional to the vertical and horizontal axes of the ellipses for an equivalent antenna with type 4B elements.

FIG. 4D shows a further simplification where the isoresistive contours are the sides of a triangle whose base and vertex height are scaled to be proportional to the vertical and horizontal axes of the ellipses for an equivalent antenna with type 4B elements.

FIGS. 4A and 4B represent desirable contours for optimum performance. FIGS. 4C and 4D represent simplifications to enhance manufacturability.

Figure 5:
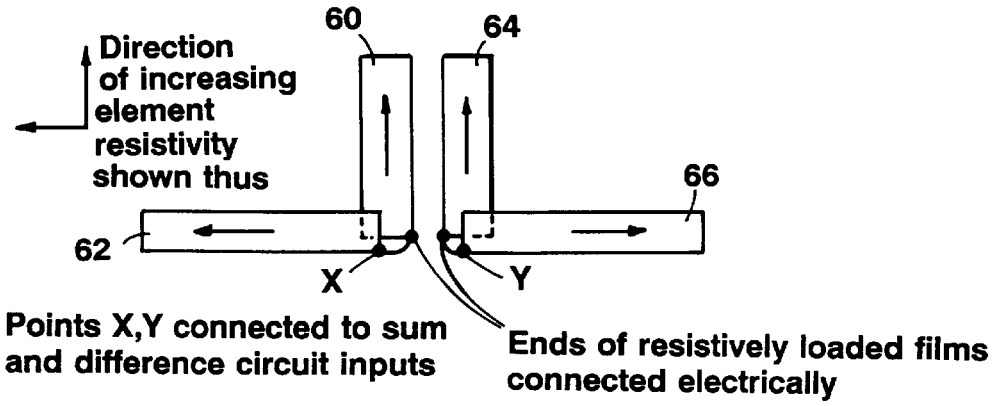
FIG. 5 shows hybrid antenna elements constructed from separate tapered resistive strips.

In the example of FIG. 5, two resistively loaded strip elements 60, 62, and 64, 66 are combined to form each of the two elements of the hybrid antenna. The lengths and resistive tapering of the two strips that compose each element are adjusted to obtain the required bandwidth and low frequency performance.

It is known that transformers with very large bandwidths can be constructed by replacing the windings of conventional transformers with transmission lines wound around a high permeability magnetic core. The impedance transformation ratio of the transformer is determined by the number of transmission lines used and the pattern in which they are interconnected.

Figure 6:
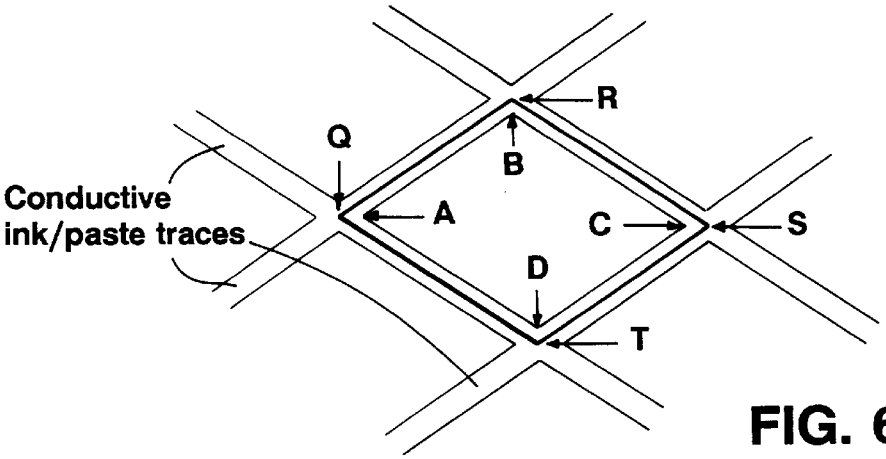
FIG. 6 shows resistive sheet materials produced by printing using conductive media.
Figure 7A:
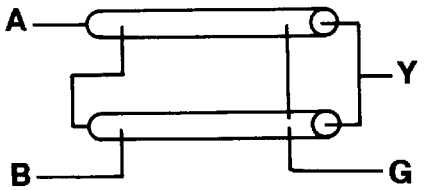
FIGS. 7A, 7B show transmission line transformer implementations of the summing and differencing devices.

FIG. 7A shows a transformer designed according to the methods of Guanella. This transformer is a simple example of a balanced to unbalanced (balun) transmission line transformer with an impedance transformation ratio of 1/4. The balanced impedance secondary side of the transformer is connected to the feedpoint of the antenna (points A and B in FIG. 6). Because the antenna is connected to the balanced side of the transformer, the output voltage at the point Y with respect to the ground terminal G is proportional to the difference in voltage between the inputs A and B. The device can therefore be used as the difference device in the hybrid antenna of FIG. 3 to provide both VHF and UHF outputs to a television receiver.

Figure 7B:
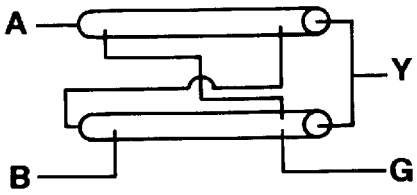

By changing the connection and therefore the phasing of the transmission lines, the summing transformer of FIG. 7B can be constructed. The output Y of this device is proportional to the sum of the inputs A and B, and it therefore can be used as the summing device in the hybrid antenna of FIG. 3 to provide VHF inputs to an FM radio receiver.

In general, the various balun transformers discussed in Guanella, "New Method of Impedance Matching in Radio Frequency Circuits, Brown Boveri Review, September 1944, pp. 327–239; Ruthroff, "Some Broadband Transformers", Proceedings of the Institute of Radio Engineers, Vol. 47, pp. 1337–1342, August 1959; or McClure, "Broadband Transmission Line Transformer Family Matches a Wide Range of Impedances", RF Design, pp. 62–66, February 1994, can be used as differencing devices in the antenna design of FIG. 3 to provide an appropriate impedance match for particular values of the antenna feedpoint impedance and television set input impedance. By a suitable change of connection any appropriate balun design with the required impedance transformation ratio can be transformed into a summing network and used as the summing device in the design of FIG. 3.

Asymmetric Vertical Sheet Antenna

Figure 8:
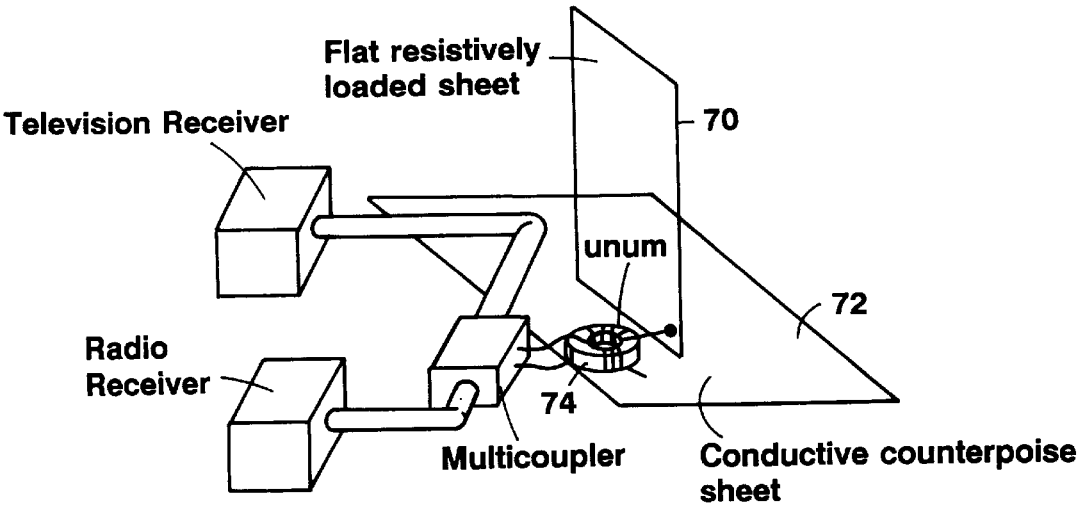
FIG. 8 shows asymmetric resistively loaded sheet antenna.

FIG. 8 shows a variant of the hybrid antenna of FIG. 3. In this antenna a single resistively loaded sheet 70 with a loading profile as shown in FIG. 4, or one of the pair of resistively loaded element of the type shown in FIG. 5, is used as an antenna element that is sensitive to the incident electric field in both the horizontal and vertical polarizations. This is achieved by connecting the sheet at one of the lower corners close to the counterpoise 72 to achieve monopole behavior in the vertical modes, and asymmetric dipole behavior in the horizontal mode. The output of the antenna is connected to a balun 74, to provide an impedance match to the antenna load. The output of the unun is connected to a multicoupler, a device containing a number of band pass electrical filters, which are used to isolate and select the individual signals and frequencies which are passed variously to the attached television and radio receivers.

Resistively Loaded Loop Antenna Design

Figure 9:
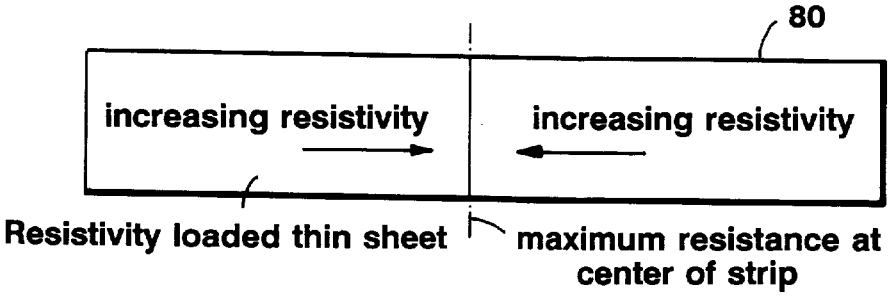
FIG. 9 shows construction of the element strip for a resistively loaded loop antenna.
Figure 10:
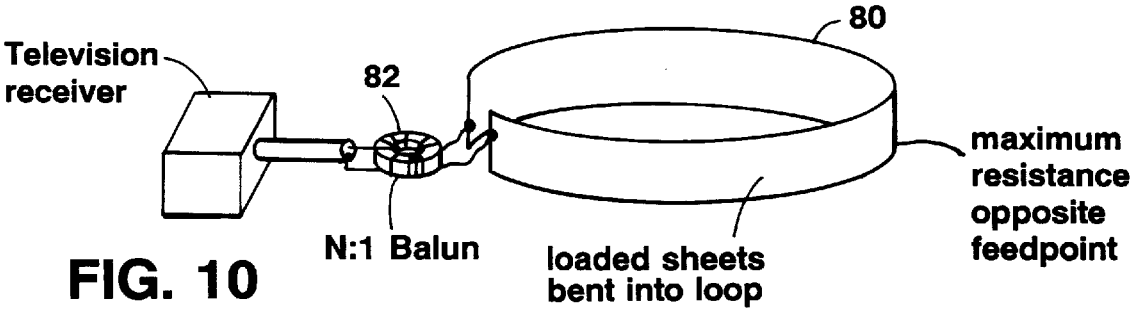
FIG. 10 shows a resistively loaded loop antenna.

A resistively loaded loop antenna can be constructed as shown in FIGS. 9 and 10. A resistively loaded strip 80 is constructed as shown in FIG. 9 such that the resistivity is low at the ends of the strip and increases towards the middle portion, with the maximum resistivity occurring at the mid point. As shown in FIG. 10, the strip is formed into a loop, which can be circular, square, or any other polygonal shape. A balun 82 is connected with its balanced side connected to the ends of the resistive sheet. The unbalanced side of the transformer is connected via a cable to the input of the television receiver. The impedance transformation ratio of the balun is selected to match the terminal impedance of the loop to the input impedance of the television receiver.

The loop is shown with its plane horizontal in FIG. 10. By means of a suitable mechanical pivot mechanism placed close to the feedpoint of the antenna the loop can be arranged such that its plane can be adjusted between the horizontal and vertical positions in order to optimize reception at any particular location.

Fabrication

One method of fabricating these antennas is from plastic films sputtered with thin metallic layers. The antenna elements may be constructed from a variety of conductive materials: evaporated or sputtered thin metal films; conductive inks or paints; conductive ceramics or glasses; alloys; cermets (ceramic-metallic alloys); lumped element resistors; ferromagnetic materials; or electroless plated metal films. Control of the impedance along the element length can be effected by a variety of means including: variation of the thickness or width of the element material; the use of materials or combinations of materials with differing electrical conductivities and permittivities at various places on the element; the perforation of the material from which the element is fabricated with holes or voids such that the impedance is controlled by the size and quantity of holes or voids within the element material.

Of the possible materials to be used for the metallization the overall choice would be based on a trade-off of the material resistivity and metallization thickness. In general less resistive (more conductive) metals and alloys, e.g., silver, bronze, copper, allow the use of thinner metallization thicknesses to achieve the same resistance, but tend to exhibit greater optical reflection and absorption coefficients and therefore may be more visibly objectionable in the case where the antenna is mounted on the TV screen. Higher resistivity metals and alloys, for example, NiChrome and stainless steel can also be vacuum sputtered and while requiring greater thickness to achieve the same resistance, they tend to have lower optical reflection and absorption coefficients and therefore can be made less visually objectionable.

The thickness of material required to achieve the tapered loading on the antenna element depends on the conductivity of the material selected, the range of element conductivities required and the required optical transmittance. For example, high conductivity materials such as copper, bronze or silver would require material thicknesses in the range $3.4\times10^{-8}$ to $3.3\times10^{-9}$ meters. Other materials would require different material thicknesses.

The desired loading characteristic may be implemented as a continuous curve, or for convenience in production, the desired continuous resistive profile may be approximated by means of a series of stepped resistivity increments, the antenna element being divided into a series of connected segments of differing resistivities. The resistivity of each connected section is then made equal to the mean resistivity value of an equivalent continuous loaded antenna over the same range of element longitudinal and lateral coordinates. Providing the segment dimensions are sufficiently small compared to a wavelength, $\lambda$(e.g., $<\lambda/10$ at the highest frequency of interest, or <1.5" at the upper TV frequency of 806 MHz), the change in the actual current distribution produced by this discretization is small at any location on the surface of the antenna. The performance of the antenna implemented with discretized resistivity values is therefore virtually identical with that obtained from an antenna with truly continuous resistive loading.

For a sheet antenna the resistivity value for each discretized segment is the average value of the resistivities at the coordinates on an equivalent continuously loaded antenna which correspond to the corners of the segment in the discretized antenna.

Assuming the material used for the antenna element has a resistivity $\rho$ ohm meters, and the segment of the element is desired to have a resistance of R ohms/square, for simple sheet materials with isotropic electrical resistivity, the required material thickness T can be calculated as:

$$T=\rho/R \text{ meters}$$

Figure 11:
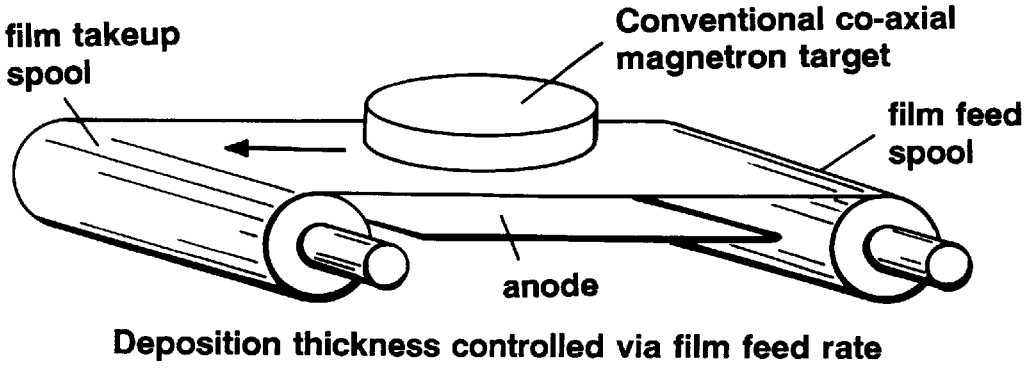
FIG. 11 shows a technique for producing variable resistivity metal films (longitudinal variation only).

As shown in FIG. 11, existing sputtering technology can provide tapered resistivity along the element length. Cyclic adjustments of film feed rate with time may be used to produce multiple sections of film with the required longitudinal resistive profile produced as metallized sections along the length of the film sheet. High feed rates result in thinner, more resistive film being deposited, slow feed rates result in thicker, less resistive metallization. Existing production techniques are designed to metallize plastic film to a high degree of uniformity across the width except for the sections close to the edge of the magnetron target. Use of a small diameter magnetron target assembly could therefore be used to provide some degree of edge tapering for the simple sheet or dual monopole type elements.

Figure 12A:
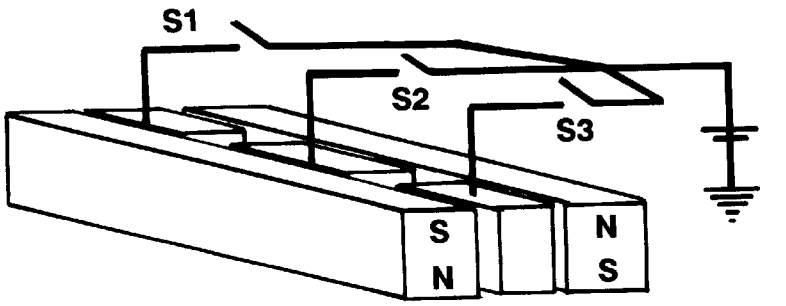
FIG. 12 shows a technique for sputtering metal films with longitudinal and lateral variance in resistivity.
Figure 12B:
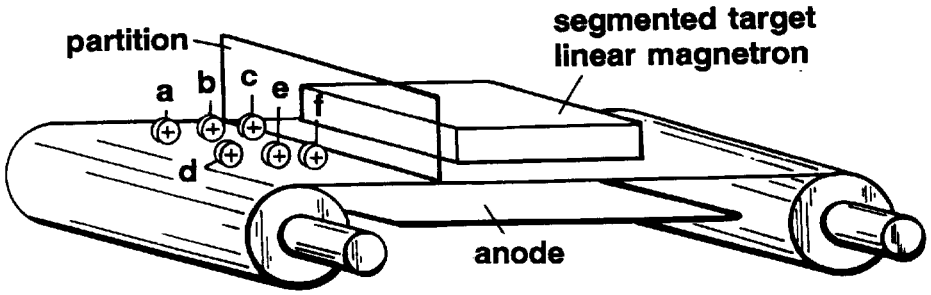
Figure 13A:
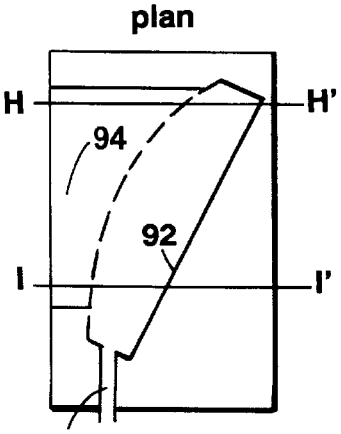
FIG. 13 shows an extrusion head for continuous production of profiled loaded impedance antenna elements.
Figure 13B:
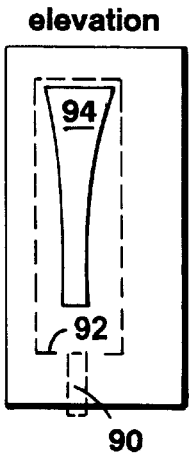
Figure 13C:
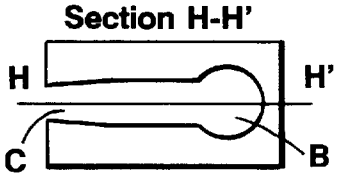
Figure 13D:
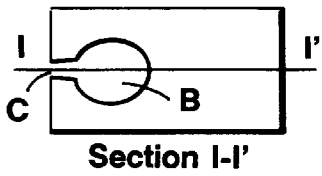

An alternative production method, shown in FIG. 12, would sputter metallic films with controlled variation in resistivity in both the longitudinal and lateral directions.

The target fabricated from the metal to be sputtered would be divided into a series of smaller linear targets. These target segments are placed in rows. The width of the individual targets, as measured at right angles to the direction of film flow, are selected to be small enough to provide the required resolution for the individual features of the antenna element to be produced while not being so small as to require frequent replacement. The thickness of the targets, as measured in the direction of film flow, is also selected to ensure that element features can be produced with sufficient resolution, too large a thickness having an integrating effect on the resolution of the element shape. Each linear array of targets is flanked by magnets with alternating polarization in order to provide a crossed electric and magnetic field which is known to promote plasma ionization and therefore efficient sputtering. Arrays of targets designed to produce different antenna element features are stacked side-by-side with their longest axis orthogonal to the direction of film flow. In order to increase film throughput several arrays of identically sized targets may be used, especially where an essentially conductive and therefore heavily metallized element is required.

In operation, selective sputtering is achieved, by a combination of film flow speed, as in conventional longitudinal resistivity control, and selective enabling of the individual targets as required, in order to selectively sputter features onto small, localized segments of the film. The antenna element shape is formed by overlapping these smaller sputtered segments into a composite whole. The targets can be enabled as shown in FIG. 12, by switched connection (S1, S2, S3) to a source of negative voltage, or by connection of each target to an individual source of variable negative voltage, whose magnitude is controlled to produce the required local instantaneous rate of deposition.

To monitor the resistivity of the completed antenna element, a series of rollers or other electrical probes is used to monitor the local resistivity between different position on the surface of the metallized film, the position of these probes being selected with regard to the resistivity profile and shape characteristics of the particular shape of the antenna element to be produced. In order to simultaneously monitor the resistivity of multiple points on the surface of the metallized film, the probes b, c, d, e, f, . . . are connected to calibrated AC voltage sources of differing frequency with contact (a) as a common current return. The current flowing from each source is then measured, frequency domain filtering being used to discriminate between the current flowing in the film path between contact (a) and the (nth) contact and the current flowing between the, (mth) contact and contact (a), where $m\neq n$. By measuring the current flowing in the contacts b, c, d, e, f . . . , and knowing the excitation voltages, the metallized film resistances between contact (a) and the other contacts b, c, d, e, f . . . , can be calculated. The diagonal resistances between these other probes, e.g., between (b) and (c) can easily be calculated using matrix methods, and subsequently compared for process control purposes with expected resistance values obtained from modeling of the antenna element resistivity by means of techniques such as finite element methods.

The flow of the plastic substrate film and the point in time and degree to which each targets is enabled is controlled by a computer which also monitors the data from the resistance measurement contacts. A variety of control algorithms can be used to implement an adaptive process control system whereby the measured resistance values from the last antenna element are compared with the desired resistance values and the errors between these two sets of values are then used to modify the film feed rate and target potential waveforms in order to reduce the resistance errors in the next antenna element produced. This process compensates for performance variations in the sputter targets as they erode during use.

Antennas for television reception can be fabricated using the metal sputtering techniques described above, but to reduce production costs other schemes may be used. Materials with higher resistivities than those found in metals can be fabricated to produce broadband antenna elements without resort to sputtering or vapor deposition because of the larger material thicknesses required. Candidate materials include a wide range of conductive polymers, polymer/metal fibre, polymer/metal flake, polymer/carbon fibre composites and conductive metal—ceramic composites or alloys, whose electrical conductivity can be adjusted to a desired value by controlling the ratio of the components from which the material is produced.

Examples of possible polymeric materials suitable for the production of antenna elements include but are not limited to polyanilines, polypyrrols, polyacetylenes and poylthiophenes. Possible polymeric composite materials include but are not limited to conductive polycarbonates incorporating conductive metal fibres, conductively coated glass fibres or conductive metal flakes in the necessary proportions to produce the required level of electrical conductivity.

Selection of materials with appropriate electrical conductivities can result in required element thicknesses in the range 1.0 to 0.0001 inches. Production of antenna elements from these materials can then be performed using a variety of techniques including mechanical machining, casting, injection moulding and extrusion. In the case of metal-ceramic composites and alloys the green material can be formed to the correct element shape and thickness and thickness by pressure casting or extrusion before firing is performed to produce the completed component. Conductive polymers which are not suitable for extrusion may be machined or alternatively dissolved in solution and cast to the correct shape using solvent evaporation techniques.

Appropriate use can be made of several materials within one antenna element. Components can be constructed from several materials with differing electrical volume resistivities which can then be conductively bonded together to produce the completed article. In particular, this can be used to ensure that all sections of the antenna element can be made with sufficient thickness to be mechanically self-supporting. Those sections of the antenna element where the use of a less resistive material would require a thin, and therefore flimsy material could be fabricated with a more resistive material, thus allowing the production of a thicker and more robust implementation in this portion of the design.

The following extrusion method is readily applicable to thermoplastically deformable materials with volume resistivities in the range 0.01 to 1 ohm meters and provides a cost effective form of continuous antenna element manufacture.

The extrusion head shown in FIG. 13 comprises the following components: (1) An injection inlet to allow for the injection of a conductive polymer or green ceramic-metal composite paste under pressure (part 90 in FIG. 13). (2) A connected manifold or internal hollow chamber 92 to allow the distribution of the plastic conductive material for a distance equivalent to the length of the antenna element. (3) A connected variable width slot 94, which connects the manifold 92 and permits the extrusion of the conductive material under pressure. As shown in the elevation drawing, the slot is machined with a shape such that: (i) Its width or smallest dimension is variable, and is adjusted to extrude the thickness of material required in order to meet the resistance requirements of the antenna element design at any particular position along its length. (ii) Its length, or longest dimension, is equal to the length of the antenna element to be produced. (iii) Its depth, or the distance from the wall of the internal manifold to the external wall of the extrusion device, is variable as shown in sections H—H' and I—I'. The depth is smallest at the point where the slot width is least, and greatest where the slot width is a maximum. At points between these extrema, the depth of the slot is of proportional intermediate value. (iv) The width of the slot is smallest at the inlet, high pressure or injection end of the manifold, and widest at the low pressure end of the manifold. This, combined with the variable depth of the slot, is used to equalize the impedance to flow along the length of the slot and so ensure that the velocity of the extruded material is constant across the length of the slot. These two elements work to prevent the preferential extrusion of the material at the wider end of the slot. (v) The dimensions used in (i) and (ii) are duly compensated for the shrinkage of the particular conductive material due to subsequent cooling or other processing stages.

The material is extruded as a continuous sheet, whose resistance varies in a controlled manner at right angles to the direction of extrusion due to the thickness profile in this direction. The material can be cut into strips or sheets at right angles to the direction of extrusion, and the resulting sections used as element components for resistively loaded antennas.

Resistively loaded antenna elements also may be produced by printing conducting grid patterns on suitable substrate materials using conductive inks, pastes or any other conductive printable material. These materials may be applied by means of silkscreening, ink-drop printing or any other suitable means of applying the conductive material.

As shown in FIG. 6, the resistive material is produced by laying down conductive material in the form of strips or segments of approximately uniform thickness, printed or written on the surface of an essentially non-conductive substrate. The strips or segments are distributed on the surface such that each segment interconnects with at least two neighbors, and jointly they form boundaries which define a regular spatial array of polygonal areas composed of uncovered substrate. The uncovered substrate areas may be any polygonal shape or combination of polygonal shapes with any number of sides, that are capable of accurately tiling the surface area of the antenna element.

The resistance of the antenna element in any region is adjusted by controlling the ratio of the area of substrate covered by the conductive material to the area of substrate which is left bare. In FIG. 6 an example of a simple lattice of conductive strips is shown which encloses a series of parallelogram shaped non-conductive areas. The effective resistivity of the conductor lattice in this area is the product of the surface resistivity of the conductive material and the difference in area of the partially-conductive and non-conductive parallelograms (areas ABCD—QRST in FIG. 6). By careful selection of the local repeat parameter, or local distance over which the conductor pattern repeats itself, and the local thickness and width of the conductive strips, the resistance of the material in any region of the antenna element may be adjusted to that required by the design. A limitation of this technique is that the dimensions of the non-conductive polyhedra areas used must be small compared with a wavelength in order that the current distribution on the element, and therefore the radiation and impedance characteristics, approximate closely to that of a continuously loaded antenna.

Additional information concerning sheet antennas using tapered loading can be found in U.S. patent application Ser. No. 08/387,131 filed on the same day as this application.

Other embodiments are within the scope of the following claims.

We claim:

1. A television antenna exhibiting a bandwidth including the entire VHF and UHF broadcast bands, a low voltage standing wave ratio, and an essentially omnidirectional radiation pattern, the antenna comprising pair of antenna elements configured as a dipole, each of the elements being formed as a sheet including an electrically resistive material, each sheet having a free end and a feedpoint end opposite the free end, the resistive material of each sheet being configured to define a pattern of voids and non-voids the voids and non-voids being arranged so that the resistance per unit length of the sheet increases with distance from the feedpoint.

2. The antenna of claim 1 in which the elements are generally rectangular.

3. The antenna of claim 1 in which each of the elements is formed as a loop.

4. The antenna of claim 1 in which each of the elements is generally planar.

5. The antenna of claim 1 in which the two antenna elements lie in a common plane.

6. The antenna of claim 1 further comprising a conductive end-loading strip along one end of each of the antenna elements.

7. The antenna of claim 1 further comprising a balun connected between the feedpoint and a television receiver.

8. The antenna of claim 1 further comprising a counterpoise element mounted below and inclined at an angle to at least one of the antenna elements.

9. The antenna of claim 1 in which the resistance varies monotonically with distance from the feedpoint.

10. The antenna of claim 1 wherein the resistance along each of the elements is characterized by iso-resistive contours of equal resistance and each of the iso-resistive contours is in the shape of a parabola centered at the feedpoint.

11. The antenna of claim 1 wherein the resistance along each of the elements is characterized by iso-resistive contours of equal resistance and each of the iso-resistive contours is in the shape of a quadrant of an ellipse.

12. The antenna of claim 1 wherein the resistance along each of the elements is characterized by iso-resistive contours of equal resistance and each of the iso-resistive contours is in the shape of a quadrant of a rectangle.

13. The antenna of claim 1 wherein the resistance along each of the elements is characterized by iso-resistive contours of equal resistance and each of the iso-resistive contours is in the shape of an oblique line.

14. The antenna of claim 1 wherein at least one of the elements comprises a pair of subelements orthogonal to one another.

15. The antenna of claim 1 wherein the feedpoint is at a corner of each of the elements.

16. The antenna of claim 1 wherein the feedpoints of the two elements are connected to a summing device and to a differencing device.

17. The antenna of claim 1 in which each of the elements has a thickness profile that varies across the element.

18. The antenna of claim 17 wherein the thickness of the electrically resistive material varies continuously from a greatest thickness at the feedpoint to a smallest thickness at the free end.

19. The antenna of claim 1 in which each of the elements comprises a conducting polymer.

20. The antenna of claim 1 wherein the resistance per unit length of the sheet at points along the sheet is controlled by arrangement of the voids and non-voids.

21. The antenna of claim 1 wherein the void areas comprise holes.

22. The antenna of claim 1 in which the voids comprise perforations in each of the elements.

23. The antenna of claim 1 in which the voids comprise uncovered areas of a substrate defined in conductive material on the substrate.

24. A television antenna comprising a pair of antenna elements configured as a dipole, each of the elements comprising a planar dielectric sheet bearing a coating of conductive material, the coating having a pattern of voids and non-voids that varies with distance along the element and, a balun connected to feed the pair of elements, the resistance per unit length of each of the antenna elements varying with distance along the element from its feed point as a result of the pattern.

25. A television antenna exhibiting a bandwidth including the entire VHF and UHF broadcast bands, a low standing voltage wave ratio, and an essentially omnidirectional radiation pattern, the antenna comprising a dipole pair of antenna elements, each of the elements being formed as a flat sheet of a resistive material having substantially uniform thickness, each of the elements having a feedpoint, the sheet having a pattern of voids of the resistive material arranged so that the resistance per unit length increases with distance along the element from the feedpoint, and the pattern of voids includes reduced thickness areas in the sheet where the resistance per unit length of the sheet at points along the sheet is controlled by arrangement of the size and quantity of void areas in the sheet.

26. An antenna comprising an antenna element being formed as a sheet, including electrically resistive material having a predetermined resistance per unit length, the sheet having a free end and a feedpoint end opposite the free end, the resistive material of the sheet being configured to define a pattern of voids and non-voids being arranged to provide the sheet with a resistance per unit length having a magnitude which varies along the antenna element from its feedpoint end.

* * * * *